United States Patent [19]

Lewin et al.

[11] 4,434,946

[45] Mar. 6, 1984

[54] STRAND GUIDE FOR PACKAGING APPARATUS

[75] Inventors: David F. Lewin, Newark, Ohio; Louie J. Haynes, Amarillo, Tex.; Lynne B. Beach, Newark, Ohio

[73] Assignee: Owens-Corning Fiberglas Corporation, Toledo, Ohio

[21] Appl. No.: 481,531

[22] Filed: Apr. 1, 1983

[51] Int. Cl.[3] ..... B65H 54/08; B65H 54/28; B65H 57/04

[52] U.S. Cl. ..... 242/18 G; 242/42; 242/157 R

[58] Field of Search ..... 242/18 G, 18 R, 42, 242/157 R; 65/10.1

[56] References Cited

U.S. PATENT DOCUMENTS

| | | | |
|---|---|---|---|
| 3,367,587 | 2/1968 | Klink et al. | 242/18 G |
| 3,371,877 | 3/1968 | Klink et al. | 242/18 G |
| 3,547,361 | 12/1970 | Klink | 242/18 G |
| 3,801,032 | 4/1974 | Sears et al. | 242/18 G X |
| 3,897,021 | 7/1975 | Shape | 242/18 G |
| 4,130,248 | 12/1978 | Hendrix et al. | 242/18 G |
| 4,322,041 | 3/1982 | Schuller et al. | 242/18 G X |

*Primary Examiner*—Stanley N. Gilreath

*Attorney, Agent, or Firm*—Ronald C. Hudgens; Greg Dziegielewski; Paul J. Rose

[57] ABSTRACT

A strand guide reciprocable along a winding collet as part of a package builder and having an upper strand-reciprocating portion and a lower strand-flattening portion.

4 Claims, 5 Drawing Figures

STRAND GUIDE FOR PACKAGING APPARATUS

TECHNICAL FIELD

This invention relates generally to apparatus for continuously attenuating glass filaments from molten glass in a bushing and winding a strand formed from the glass filaments into a package, and more particularly to a reciprocable strand guide which flattens the strand as it is would onto the package.

BACKGROUND ART

U.S. Pat. No. 3,897,021 discloses filament attentuating and strand winding apparatus wherein the traversing strand guides 72 and 73 (FIGS. 4–6) are generally in the form of blocks having straight strand receiving channels in front faces thereof facing the packages. The strands wound with the aid of such strand guides are generally round in cross section.

DISCLOSURE OF THE INVENTION

In accordance with the invention, a traversing strand guide is provided with an upper slotted strand-reciprocating portion and a lower strand-flattening portion, the strand-flattening portion flattening out the strand as it contacts the package being wound. In filament winding operations, flattened strand from a package wound with the aid of the novel strand guide wets out with resin faster than does round strand, giving uniform impregnation and permitting increased processing speeds.

BRIEF DESCRIPTION OF THE DRAWINGS

The invention is more particularly described with reference to the accompanying drawings in which.

BEST MODE OF CARRYING OUT THHE INVENTION

Figures 1, 2, 3:
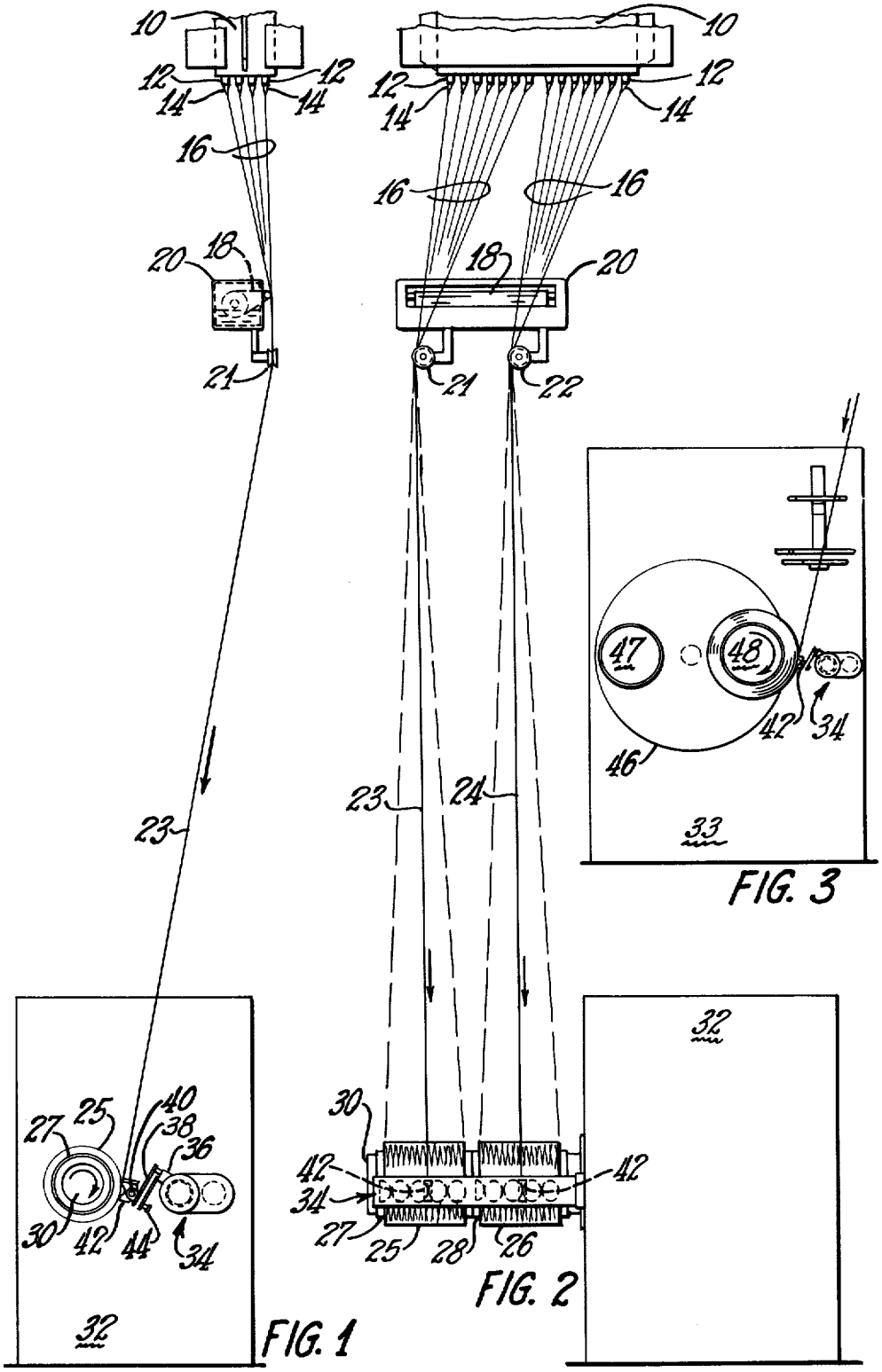
FIG. 1 is a front elevational view of glass strand forming and packaging apparatus including a pair of strand guides constructed in accordance with the invention.
FIG. 2 is a side elevational view of the apparatus of FIG. 1.
FIG. 3 is a front elevational view of an alternative packaging apparatus including strand guides constructed in accordance with the invention.

With respect to the drawings, FIGS. 1 and 2 fragmentarily show a bushing 10 to which molten glass is fed. The bushing 10 includes a bottom wall having tipped orifices 12 through which molten glass flows to form cones 14 of molten glass. The cones 14 are attenuated into filaments 16, and the continuously formed filaments 16 are pulled across an endless moving belt 18 of a size applicator 20 having a pair of spaced gathering shoes 21 and 22 suspended therefrom for gathering two groups of the filaments 16 respectively into a pair of strands 23 and 24. The strands 23 and 24 are respectively wound into two packages 25 and 26 on tubular cores or spools 27 and 28 disposed on a rotatably mounted winding collet 30 of a winder 32 such as shown and described in U.S. Pat. No. 3,897,021, which is incorporated herein by reference.

Extending parallel to the winding collet 30 is a package builder 34 including a barrel cam having a pair of continuous helical grooves for respectively reciprocating a pair of cam follower blocks 36, one of which is shown in FIG. 1, back and forth along the collet 30. Each cam follower block 36 has a flexible spring member 38 mounted thereon and provided with a pair of spaced ears 40 adjacent a lower end for the mounting of a strand guide 42 constructed in accordance with the invention. Each cam follower block 36 also has a proximity switch 44 mounted thereon for controlling back-off of the package builder 34 as the packages 25 and 26 build up.

The package builder 34 including strand guides 42 is also adopted to be used on an automatic winder 33 (FIG. 3) such as disclosed in U.S. Pat. No. 4,349,365, which is incorporated herein by reference. The winder 33 includes a rotatably indexable turret 46 having a pair of winding collets 47 and 48 rotatably mounted thereon so that one can have wound packages removed therefrom and new cores installed thereon while the other is having packages wound thereon. The driving means for the turret 46 and the collets 47 and 48 may be substantially the same as disclosed in U.S. Pat. No. 4,052,015, which is incorporated herein by reference.

Figure 4:
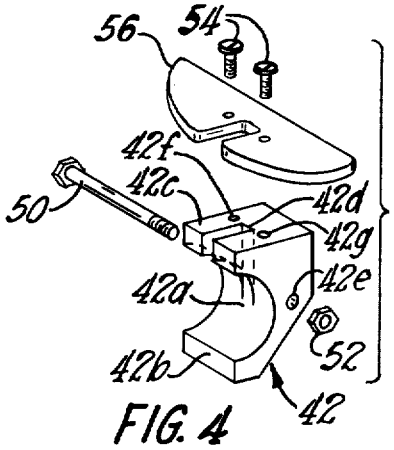
FIG. 4 is an exploded perspective view of a strand guide constructed in accordance with the invention and associated parts.
Figure 5:
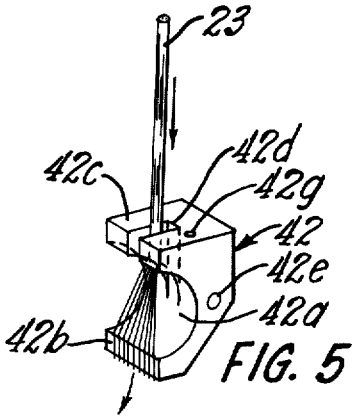
FIG. 5 is a perspective view of the strand guide of FIG. 4 schematically illustrating the flattening of a strand guided thereby.

One of the strand guides 42 is more clearly shown in FIGS. 4 and 5 and is a particularly shaped block preferably made of phenolic resin reinforced with laminations of cloth, commercially available as Westinghouse Micarta grade 221. A front face of the strand guide normally engaging a package being wound has a recess **42*a* generally at mid-height to provide the strand guide with a lower squeegee or strand-flattening portion 42*b* and an upper strand-reciprocating portion 42*c*. The strand-reciprocating portion 42*c* is provided with a central generally vertically extending slot 42*d*. The recess 42*a* is preferably semicylindrically shaped and oriented with the cylindrical axis extending horizontally. The radius of the semicylindrical surface defining the recess 42*a* is preferably equal to the depth of the slot 42*d*measured in a substantially horizontal direction, whereby the surface defining the horizontally inner end of the slot 42*d* is tangent to the surface defining the recess 42*a*** and terminates with its lower end at the line of tangency.

A hole **42*e* extending horizontally through the strand guide 42 is provided for reception of a mounting bolt 50 cooperable with a nut 52 in the securing of the strand guide in the ears 40 on the spring member 38 (FIG. 1). Also, two blind holes 42*f* and 42*g* are provided in an upper surface of the strand guide 42 respectively on opposite sides of the slot 42*d* for respectively receiving a pair of screws 54 to secure a strand threading cam 56** in place.

FIG. 5 schematically illustrates how the multifilament strand 23 is flattened out due to transverse displacement of the filaments as it passes over the squeegee portion **42*b* of the strand guide 42 immediately before being wound on the package 25. The strand-reciprocating portion 42*c* moves the strand 23 back and forth along the package 25 as the respective cam follower block 36 is reciprocated by the barrel cam of the package builder 34**.

Various modifications may be made in the structure shown and described without departing from the spirit and scope of the invention as set forth in the following claims

We claim:

1. A strand guide movable back and forth longitudinally of a winding collet as part of a package builder, said strand guide comprising a block member having a face normally engaging a package being wound from a multifilament strand guided by the block member, said block member having a recess in said face whereby it is provided with a lower squeegee or strand-flattening portion below the recess and an upper strand-reciprocating portion above the recess, the strand-reciprocating portion having a generally vertically extending slot opening to said face, and the multifilament strand being wound into a package on the winding collet being received in said slot, transversely moved back and forth along the winding collet by the strand-reciprocating portion, and flattened due to transverse displacement of the filaments by said strand-flattening portion as it is wound onto the package.

2. A strand guide as claimed in claim 1 wherein said block member is made of phenolic resin reinforced with laminations of cloth.

3. A strand guide as claimed in claim 1 wherein said recess is defined by a semicylindrical surface oriented with the cylindrical axis thereof extending horizontally.

4. A strand guide as claimed in claim 3 wherein the radius of the semicylindrical surface is equal to the depth of the slot measured from said face.

* * * * *